United States Patent [19]

Allihn

[11] Patent Number: 4,564,049

[45] Date of Patent: Jan. 14, 1986

[54] WEAVING DEVICE

[75] Inventor: Rüdiger O. M. Allihn, Bellville, South Africa

[73] Assignee: Eager Weaver (Proprietary) Limited, Cape Town, South Africa

[21] Appl. No.: 568,410

[22] Filed: Jan. 5, 1984

[30] Foreign Application Priority Data

Jan. 6, 1983 [ZA] South Africa ..... 83/0064

[51] Int. Cl.[4] ..... D03D 29/00

[52] U.S. Cl. ..... 139/33

[58] Field of Search ..... 139/29, 30, 31, 32, 139/33, 34

[56] References Cited

U.S. PATENT DOCUMENTS

| | | | |
|---|---|---|---|
| 2,166,668 | 7/1939 | Webster et al. | 139/33 |
| 3,739,437 | 6/1973 | Alberici et al. | 139/34 |
| 3,971,417 | 7/1976 | Gentil | 139/34 |
| 4,192,046 | 3/1980 | Bosch-Meevis et al. | 139/34 |

FOREIGN PATENT DOCUMENTS

| | | | |
|---|---|---|---|
| 586971 | 1/1925 | France | 139/29 |

*Primary Examiner*—Henry S. Jaudon
*Attorney, Agent, or Firm*—Alfred Stapler

[57] ABSTRACT

The invention discloses a weaving device, which includes (a) a support base adapted to support a number of weaving needles in spaced substantially parallel relationship; (b) two groups of weaving needles, each needle having a longitudinal axis and being adapted to be supported removably at one end by the support base, each needle further having a needle body, a free projecting tip at one end of the needle body and, remote therefrom, attachment means for attachment of a warp thread; and (c) moving means adapted for causing moving the tips of needles. In one embodiment each needle has (a) an elongated needle body having a longitudinal axis; (b) a locating part at one end of the needle body for supporting it removably in a support base; (c) attachment means for attaching a warp thread to the needle body; (d) a needle tip support at the end of the needle body opposite to the locating part; (e) a needle tip member having a tip and a first and a second side part respectively extending on either side away from a center line passing through the tip; (f) connection means for pivotably connecting the needle tip member to the needle tip support at a point located substantially on the center line of the needle tip and the longitudinal axis of the needle body; and (g) biasing means acting between the elongated needle body and the needle tip member for biasing the needle tip member respectively alternatively in one of two positions, namely in a first position where the one side part projects away from the longitudinal axis of the needle body and a second position where the second side part projects away from the longitudinal axis of the needle body.

12 Claims, 9 Drawing Figures

VIII
105.1, 105.2
10
118
101
52
56
86
94
74
92
96
54
70
114
58
68
100
98
122
90

IX
75
105.2
105.1
10.2
10.1

WEAVING DEVICE

BACKGROUND OF THE INVENTION

The invention relates to a weaving device.

More particularly, the invention relates to a manual weaving device, and to weaving needles associated therewith.

In manual weaving devices, where a number of weaving needles are provided, it is cumbersome to insert the weft thread alternatingly over and behind the needles. At times the weft thread may be placed wrongly over or behind a needle and this causes a flaw in the weaving pattern.

It is an object of the invention to suggest a device and needles associated therewith which will assist in overcoming this problem.

SUMMARY OF THE INVENTION

According to the invention, a weaving device includes (a) a support base adapted to support a number of weaving needles in spaced substantially parallel relationship;

(b) two groups of weaving needles, each needle having a longitudinal axis and being adapted to be supported removably at one end by the support base, each needle further having a needle body, a free projecting tip at one end of the needle body and, remote therefrom, attachment means for attachment of a warp thread; and (c) moving means adapted for causing at a first instance tips of the first group of needles to be on a first substantially straight line and the tips of the second group of needles to be on a second substantially straight line, and at a second instance the tips of the first group of needles to be moved to be on a third substantially straight line.

The moving means further may be adapted to move the tips of the second group of needles at the second instance to be on a fourth substantially straight line.

The third line may be co-axial with the second line, and the fourth line may be co-axial with the first line.

The tip of each needle may be displaceable away from the longitudinal axis of the needle.

The first group of needles may be located alternating between the second group of needles.

The moving means may be constituted in that each needle has a tip part pivotably mounted at one end of the needle. Also according to the invention, a weaving needle includes (a) an elongated needle body having a longitudinal axis;

(b) a locating part at one end of the needle body for supporting it removably in a support base;

(c) attachment means for attaching a warp thread to the needle body;

(d) a needle tip support at the end of the needle body opposite the locating part;

(e) a needle tip member having a tip and a first and second side part respectively extending on either side away from a centre line passing through the tip;

(f) connection means for pivotably connecting the needle tip member to the needle tip support at a point located substantially on the centre line of the needle tip and the longitudinal axis of the needle body; and (g) biasing means acting between the elongated needle body and the needle tip member for biasing the needle tip member respectively alternatingly in one of two positions, namely in a first position where the one side part projects away from the longitudinal axis of the needle body and in a second position where the second side part projects away from the longitudinal axis of the needle body.

The needle tip member may be of inverted V-shape, the two legs of the V-shape constituting the side parts and the apex of the V constituting the needle tip part.

Alternatively, the needle tip member may be in the form of a triangular body, two of the sides of the triangular body constituting the two side parts and the enclosed angle part between the two side parts forming the needle tip.

The needle may include stopping means for limiting the pivotation of the needle tip member to either side.

The biasing means may be in the form of a spring.

According to one embodiment the biasing means is in the form of an elongated spring which is attached at one end to the tip part of the needle tip member substantially on the centre line and between the connection means and the needle tip, and at the other end being attached to the needle body substantially on the longitudinal axis of the needle.

BRIEF DESCRIPTION OF THE DRAWINGS

The invention will now be described by way of example with reference to the accompanying schematic drawings.

In the drawings there is shown in

SPECIFIC DESCRIPTION

Figure 2:
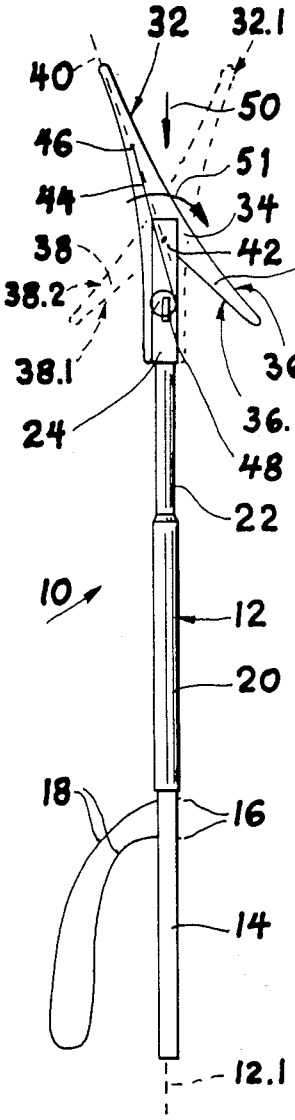
FIG. 2 a side view of the needle seen along arrow II in FIG. 1.
Figure 3:
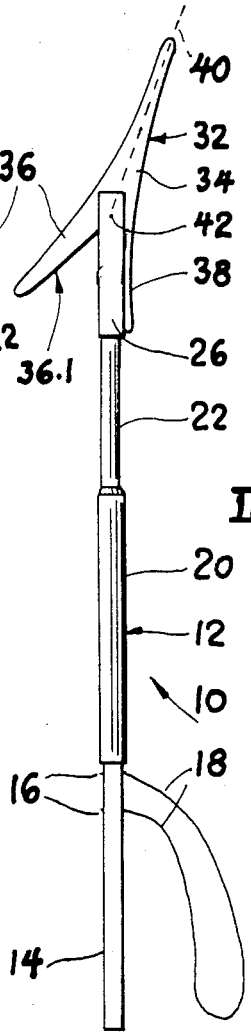
FIG. 3 an opposite side view of the needle seen along arrow III in FIG. 1.
Figure 1:
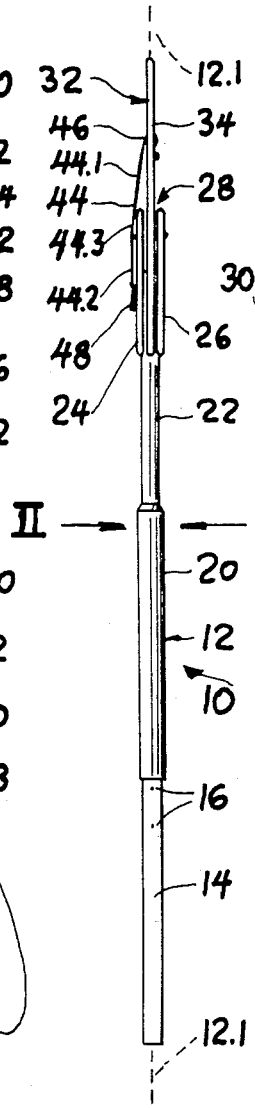
FIG. 1 a front view of a weaving needle in accordance with the invention.
Figure 4:
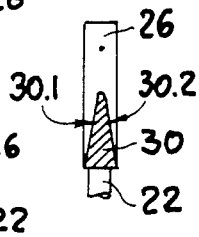
FIG. 4 a side view of the upper part of the needle corresponding to FIG. 2 but with the needle tip member and one side of the forked upper end of the needle being removed.

The needle device and its operation will be described first, and thereafter the weaving device will be described with the needles fitted in position.

Referring to FIGS. 1 to 4, the needle device 10 includes an elongated needle body 12 having a longitudinal axis 12.1. This needle body 12 has a locating end 14, which in cross-section is of rectangular shape, eg. square shape. The locating end 14 has two holes 16 for the attachment of a warp thread holder 18, eg. made of nylon thread.

The body 12 further has a centre part 20, which is of round circular shape in cross-section. On that there follows an upper or tip support part 22, which is also of circular shape in cross-section but which has a diameter which is slightly less than the diameter of the centre part 20. The upper part 22 terminates into a forkshaped end, which has two flat side plates 24, 26 defining a gap 28 inbetween them. In the gap 28 the upper part 22 terminates into an inverted V-shaped stop 30 having side abutment faces 30.1, 30.2 (see FIG. 4).

In the gap 28 a needle tip member, generally indicated by reference numeral 32, is pivotally mounted. This needle tip member is of inverted V-shape and has a needle tip part or tip 34, a first side part or leg 36 and a second side part or leg 38. The needle tip 34 has a centre line indicated by dotted lines 40. On this centre line it is pivotally connected by means of a pin 42 to the two side plates 24 and 26. Thereby the needle tip member 32 can pivot into the two positions as shown in full lines 32 and dotted lines 32.1 in FIG. 2. In either case the pivotation movement is limited by the inner face 36.1 and 38.1 of the two side parts 36 and 38 coming respectively into abutment contact with the face 30.1 or 30.2 of the stop 30 (see FIG. 4).

The needle tip member 32 is biased into one of the two positions (illustrated in FIG. 2) by means of an elongated spring 44. This spring is attached at one end 46 to the needle tip part 34 in that its end hooks into a hole provided in the tip 34. This connection hole is located on the centre line 40. The opposite end 48 of the spring 44 is attached to a hook or lug provided on the side plate 24, this connection being on the elongated centre line 12.1 of the needle body 12. The spring 44 has two straight parts 44.1, 44.2 which meet at the centre 44.3 and define a very obtuse angle between them. The end 48 has a small coil (eg. one or one and a half turns) providing the spring action for pulling the needle tip 34 against the stop faces 30.1 or 30.2 in the two pivotation positions.

The operation of the needle is such that when a weft thread is moved down in the direction indicated by arrow 50 in FIG. 2, it will come into contact with the outer face 36.2 of the side part 36 and as it moves down further it will pivot the side part 36 in the direction shown by arrow 51 and therewith move the needle tip member 32 into the position shown in dotted lines 32.1. The face 36.2 guides the weft thread onto the needle body 12. When the next weft thread is pulled down, it will come into contact with the face 38.2 of the side part 38 (as shown in dotted lines) and pivot the needle tip member 32 from the position shown in dotted lines by reference numeral 32.1 back into the position shown in full lines by reference numeral 32. This procedure will be repeated with each insertion of weft threads.

The needles 10, preferably made of any suitable material, such as synthetic plastics material such as ABS plastics (acrilonitrile/butadiene/styrene plastics), polypropylene, or metal (eg. steel or aluminium), has a certain inherent flexibility to enable them to move sideways for allowing the weft threads to be pulled down as will be described in more detail hereinafter.

Figure 5:
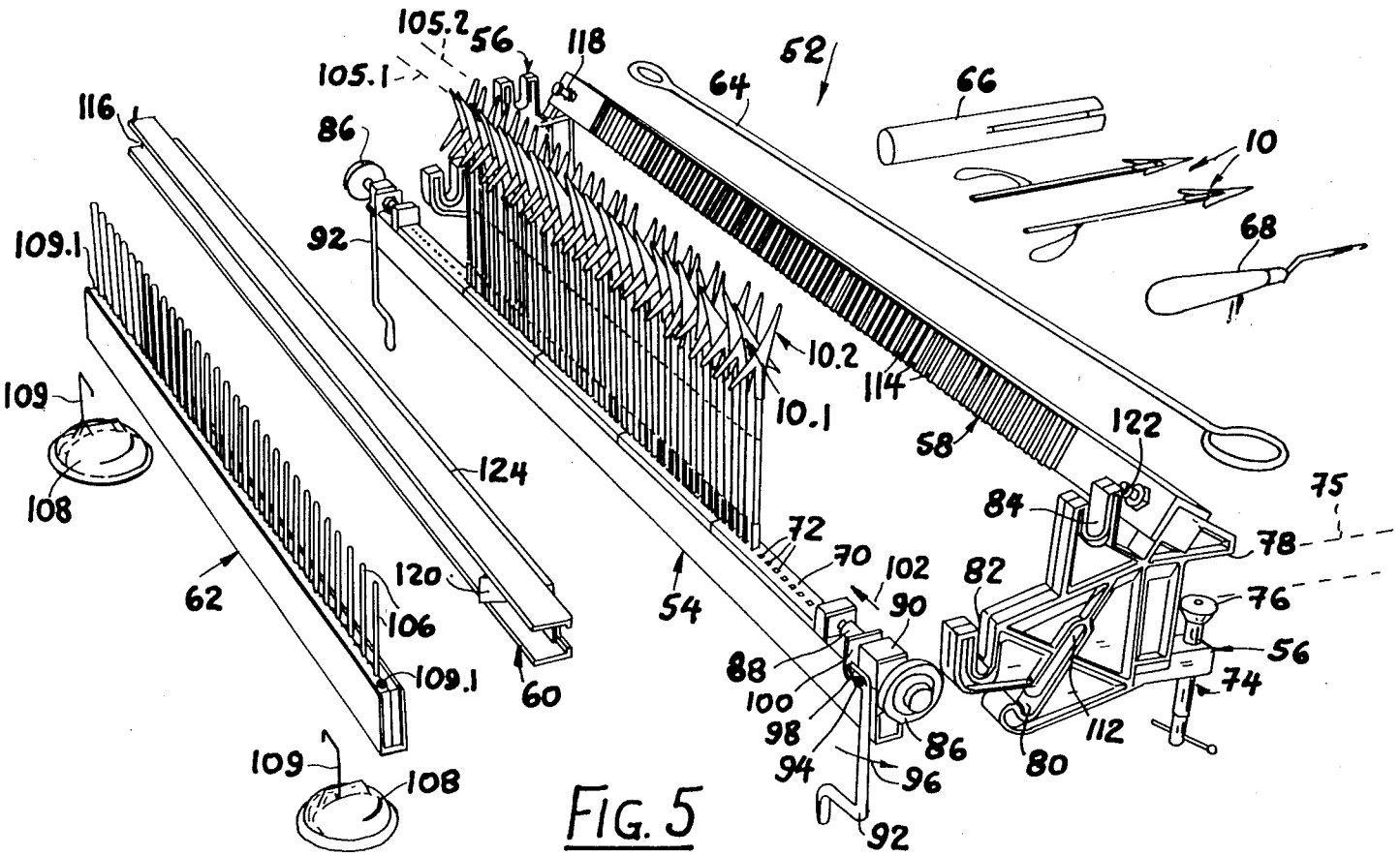
FIG. 5 an exploded view of the various parts constituting the weaving device in accordance with the invention.

Referring now to FIG. 5 the various elements of a weaving device 52 in accordance with the invention are illustrated. The elements are shown in the unassembled condition for the sake of clarity. The device 52 basically includes a locating or needle holder bar 54, two identical side plates 56, a clamping bar 58, a needle clamping bar 60, and a comb bar 62.

Auxilliary devices include an awl 64, a piling measure member 66 and a latch hook 68.

The needle holder bar 54 has an upper face 70 with sockets 72 in which the bottom ends 14 of the needles 10 are inserted removably as shown. (The needles 10 are shown schematically only in FIG. 5 and for details, reference is to be made to FIGS. 1 to 4).

The sockets 72 are rectangular in cross-section and therefore the needles 10, having equivalent rectangular locating bottom parts 14, cannot rotate once inserted in their respective sockets 72.

Figure 9:
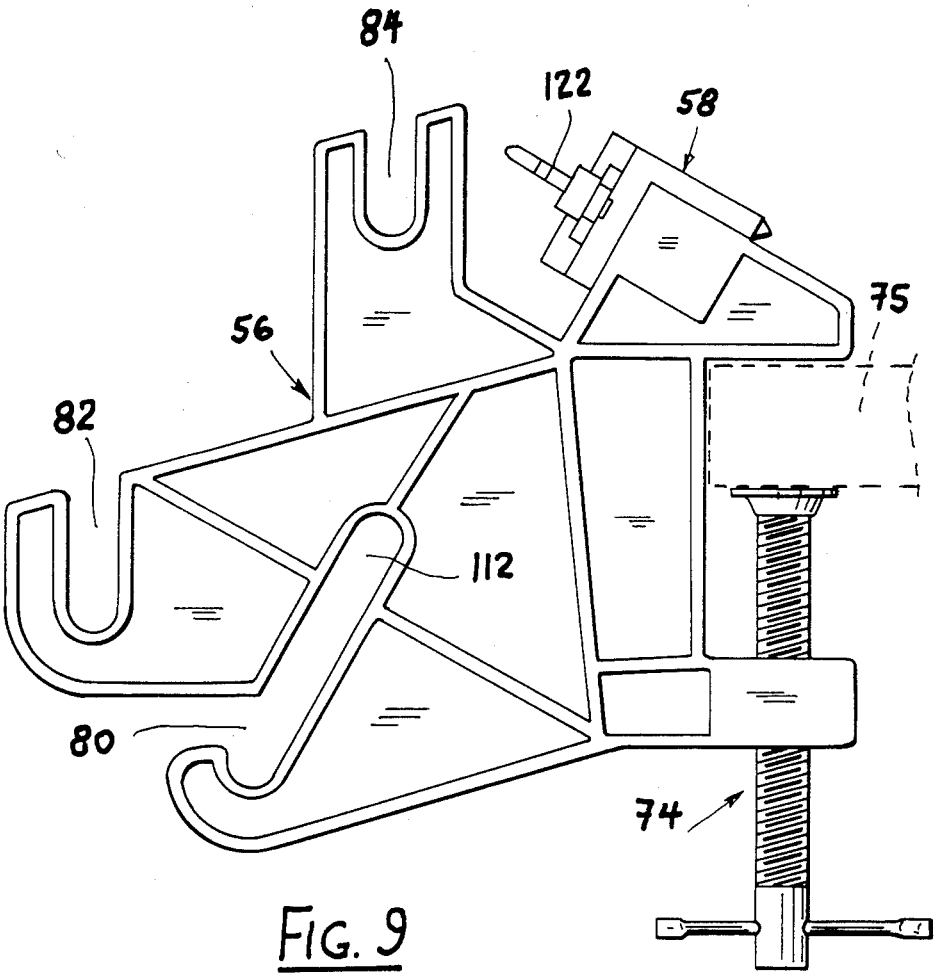
FIG. 9 on a larger scale, a side view of the side plate of the weaving device seen along arrow IX in FIG. 8.

For operation of the device, the bar 58 is attached by screws (details not shown) to the side plates 56. The side plates 56 then are clamped to a table or other support structure by means of the clamps 74 so that the table (or other panel), indicated by dotted lines 75, fits between the pressing disc 76 and the abutment face 78. The bar 58 then would be inclined as shown in FIGS. 5 and 9.

Thereafter the bar 54 is inserted into one of the locating gaps 80, 82 or 84, provided on both side plates 56 so that the face 70 is substantially horizontal and faces upwardly. (For normal plain weaving the bar 54 would be inserted into gap 80). This is done in each case by allowing the resilient disc 86, mounted on a slidable shaft 88, to fit over the respective side plate so as to be on the outside thereof with the side plate being located between this disc 86 and the end block 90 fixed to the bar 54. The lever arm 92, pivotably mounted at 94 on the block 90, then is turned in the direction shown by arrow 96 and the lever end 98 presses the end plate 100 and the shaft 88 fixed thereto against the coil spring 101 in the direction of arrow 102 so as to clamp the side plate 56 tightly between the disc 86 and the block 90.

For loosening the reverse procedure is applied.

Figure 6:
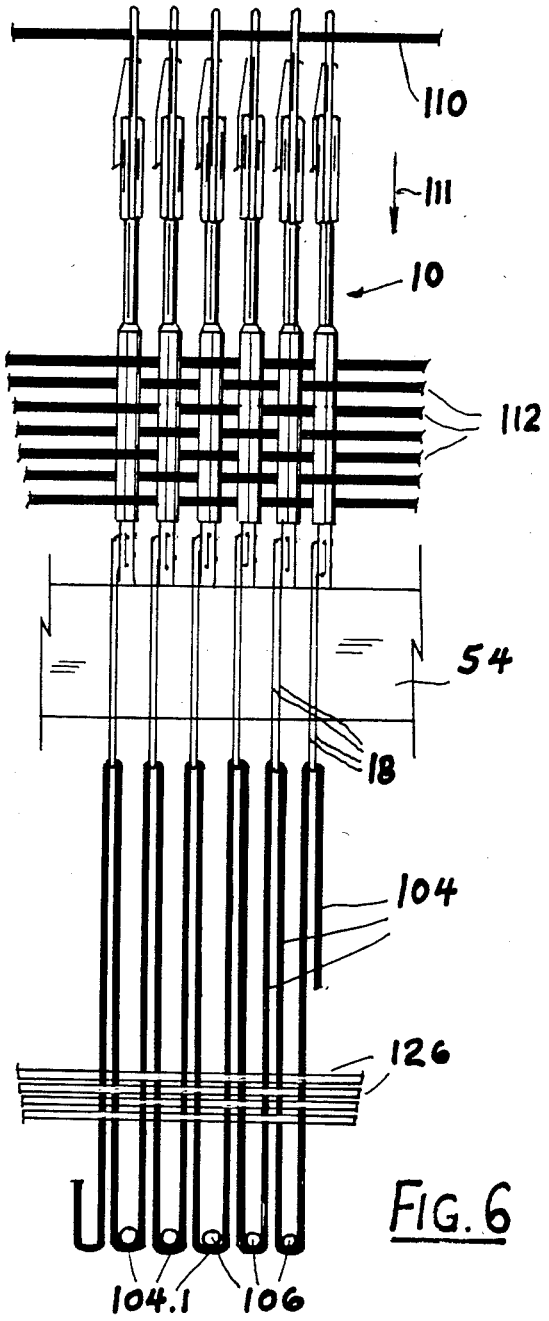
FIG. 6 a front view of a number of needles located on the locating holder bar.
Figures 7, 8:
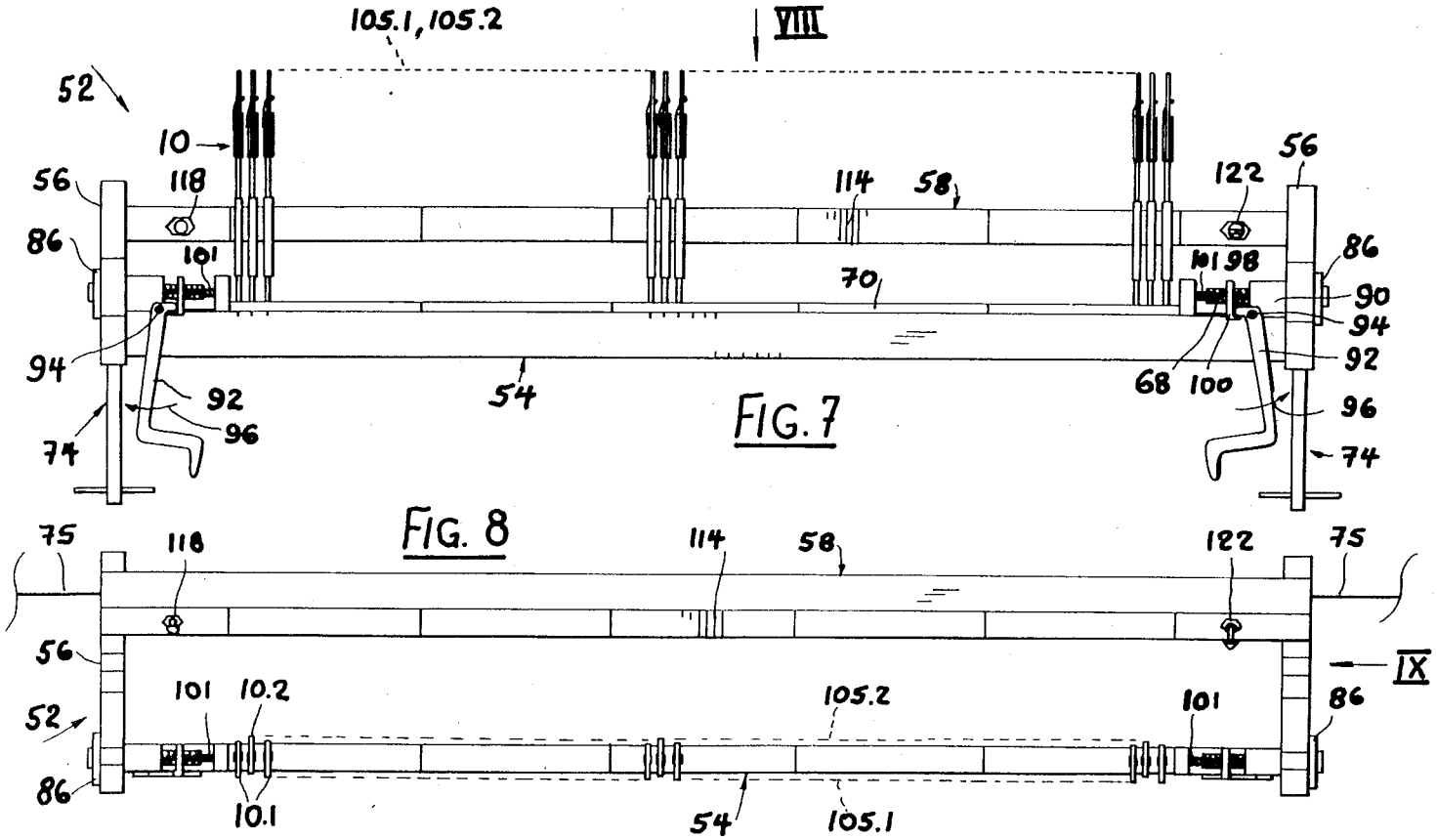
FIG. 7 on a slightly reduced scale a front view of the weaving device showing a number of needles in position on the locating or holder bar.
FIG. 8 a plan view of the device seen along arrow VIII in FIG. 7.

The needles 10 are placed in position in the sockets 72 of the bar 54 as shown in FIGS. 5 to 7 and the needle tip members 32 are pivoted into alternate directions, as shown in FIG. 5, for commencement of the weaving operation. The number of needles 10 and the width spaced apart will determine the width of the article to be woven. The needles 10 may have different colours (eg. brown and yellow) so that they can be identified easily for placing the tip members of one type of coloured needles in one direction and of the other type of coloured needles in an opposite direction. Warp threads 104 are attached to the nylon warp thread holders 18 of each needle and extend down as shown in FIG. 6 (or are placed flat on table top 75).

The needles 10 therefore are provided in two groups, namely a first group 10.1 having their tips on a line 105.1 and the second group 10.2 with their tips on a second line 105.2 shown in FIG. 5. These lines 105.1 and 105.2 are substantially parallel. When a weft thread is inserted the tips of the first group of needles will be pivotted to take up the position of line 105.2 and the second group will take the position of line 105.1. With each subsequent insertion of weft threads the tips of the two groups of needles will alternate between these two lines.

Referring to FIG. 6 the warp threads 104 are extended for a sufficient length (as a continuous thread) as determined by the length of the article to be woven. The loop ends 104.1 of the warp threads 104 are kept at a sufficient distance from the bar 54 by placing the loop ends 104.1 over the pins 106 of the comb bar 62. The comb bar 62 is held in position on the table top 75 to which, the side plates 56 are clamped, by means of the suction caps 108. The suction cups 108 which are fixed onto the table top and the hooks 109 of the caps grip into a socket hole 109.1 provided at either of the bar 62. (In this position the bar 62 will be behind the bar 54, and not in front of it as shown in the exploded view in FIG.

5). The weft thread 110 is placed in position on the needle tip parts as shown in FIG. 6, ie. is gripped by both hands and held horizontal and between the lines 105.1, 105.2 (FIG. 5). Then the weft thread 110 is pulled down in the direction of arrow 111 into the position indicated by reference numeral 112 in FIG. 6. Thereby the needle tip members 32 will pivot into opposite direction as explained with reference to FIGS. 1 to 5. The weft threads, as they are pulled down one after the other, will weave alternatingly over the needles 10 as shown.

When a sufficient number of weft threads have been woven onto the needles 10, then the bar 54 is unlocked and placed into the holding position 112. In this position the needle body parts 22 will be located in the recesses 114 provided in the bar 58. The needle clamping bar 60 is placed in position in that its forkshaped end 116 receives the headed pin 118 fixed to the bar 58 and its sliding lock 120 engages with the headed pin 122 fitted to the opposite end of the bar 58. The bar 60 has a resilient abutment strip 124, which presses the needles tightly into their respective recesses 114 and holds them firmly in this position.

Now the bar 54 can be pulled down and removed carefully. The bottom ends of the needles 10 are therefore free. This means that the warp threads 104, attached to the warp thread holders 18, are also free.

The weft threads in their holding position 112 (see FIG. 6) now can be pulled down onto the warp threads 104 into position 126 (FIG. 6), if necessary by using the comb 62. Thereafter the bar 54 is placed back into the position 112 so that the needle bottom parts 14 fit into the sockets 72. The bar 60 is unlocked and removed and then the bar 54 is again moved to the appropriate locating gap in the side plates 56, eg. gap 80. The bar 62 is then again fixed on the table top 75 by means of the suction cups 108, the warp loops 104.1 are placed over the pins 106, and the procedure is repeated. The weaving operation thereafter can continue and further weft threads can be inserted as required. The device 52 can be used to weave different patterns, shapes and sizes by utilizing the needles 10 as explained above.

I claim:

1. A weaving device, which includes (a) a support base adapted to support a number of weaving needles in spaced substantially parallel relationship;

(b) two groups of weaving needles, each needle having a longitudinal axis and being adapted to be supported removably at one end by the support base, each needle further having a needle body, a free projecting tip at one end of the needle body and, remote therefrom, attachment means for attachment of a warp thread; and (c) moving means adapted for causing at a first instance tips of the first group of needles to be on a first substantially straight line and the tips of the second group of needles to be on a second substantially straight line, and at a second instance the tips of the first group of needles to be moved to be on a third substantially straight line.

2. A device as claimed in claim 1, in which the moving means is adapted to move the tips of the second group of needles at the second instance to be on a fourth substantially straight line.

3. A device as claimed in claim 2, in which the third line is substantially co-axial with the second line, and the fourth line is substantially co-axial with the first line.

4. A device as claimed in claim 1, in which each needle tip is displaceable away from the longitudinal axis of its needle.

5. A device as claimed in claim 1, in which the first group of needles are located alternatingly between the second group of needles.

6. A device as claimed in claim 1, in which the moving means is constituted in that each needle has a tip part pivotally mounted at one end of the needle.

7. A device as claimed in claim 6, in which each needle has (a) an elongated needle body having a longitudinal axis;

(b) a locating part at one end of the needle body for supporting it removably in a support base;

(c) attachment means for attaching a warp thread to the needle body;

(d) a needle tip support at the end of the needle body opposite to the locating part;

(e) a needle tip member having a tip and a first and a second side part respectively extending on either side away from a center line passing through the tip;

(f) connection means for pivotably connecting the needle tip member to the needle tip support at a point located substantially on the centre line of the needle tip and the longitudinal axis of the needle body; and (g) biasing means acting between the elongated needle body and the needle tip member for biasing the needle tip member respectively alternatively in one of two positions, namely in a first position where the one side part projects away from the longitudinal axis of the needle body and a second position where the second side part projects away from the longitudinal axis of the needle body.

8. A weaving needle including (a) an elongated needle body having a longitudinal axis;

(b) a locating part at one end of the needle body for supporting it removably in a support base;

(c) attachment means for attaching a warp thread to the needle body;

(d) a needle tip support at the end of the needle body opposite to the locating part;

(e) a needle tip member having a tip and a first and a second side part respectively extending on either side away from a center line passing through the tip;

(f) connection means for pivotably connecting the needle tip member to the needle tip support at a point located substantially on the centre line of the needle tip and the longitudinal axis of the needle body; and (g) biasing means acting between the elongated needle body and the needle tip member for biasing the needle tip member respectively alternatively in one of two positions, namely in a first position where the one side part projects away from the longitudinal axis of the needle body and a second position where the second side part projects away from the longitudinal axis of the needle body.

9. A needle as claimed in claim 8, in which the needle tip member is of inverted V-shape, the two legs of the V forming the first and second side parts and the apex of the V forming the needle tip.

10. A needle as claimed in claim 8, which has stopping means for stopping the pivotation of the needle tip member to either side.

11. A needle as claimed in claim 8, in which the biasing means is in the form of a spring.

12. A needle as claimed in claim 11, in which the spring is an elongated spring attached at one end to the needle tip member substantially on the centre line and between the connection means and the needle tip, and at its other end to the needle body substantially on the longitudinal axis of the needle.

* * * * *